US005170616A

United States Patent [19]

Genevray

[11] Patent Number: 5,170,616

[45] Date of Patent: Dec. 15, 1992

[54] SAFETY DEVICE FOR A BANK OF SPINDLES PROVIDED WITH AN AUTOMATIC REMOVAL DEVICE

[75] Inventor: Henri Genevray, Guebwiller, France

[73] Assignee: N. Schlumberger et Cie, S.A., Guebwiller, France

[21] Appl. No.: 790,929

[22] Filed: Nov. 13, 1991

[30] Foreign Application Priority Data

Nov. 13, 1990 [FR] France ..... 90 14333

[51] Int. Cl.[5] ..... D01H 9/02

[52] U.S. Cl. ..... 57/267; 57/276

[58] Field of Search ..... 57/267, 270, 276

[56] References Cited

U.S. PATENT DOCUMENTS

| | | | |
|---|---|---|---|
| 3,380,238 | 4/1968 | Araki et al. | 57/267 |
| 4,196,575 | 4/1980 | Novak | 57/267 |
| 4,369,621 | 1/1983 | Kogiso | 57/267 |
| 4,885,904 | 12/1989 | Hunt et al. | 57/267 X |

FOREIGN PATENT DOCUMENTS

| | | | |
|---|---|---|---|
| 0310568 | 4/1989 | European Pat. Off. . | |
| 2076026 | 11/1981 | United Kingdom | 57/267 |

*Primary Examiner*—Joseph J. Hall, III

*Attorney, Agent, or Firm*—Young & Thompson

[57] ABSTRACT

A textile machine has a bank of spindles each provided with a flyer having a presser finger and a fork having a plurality of elongated teeth thereon for simultaneously removing full bobbins from the spindles and for supplying empty bobbins to the spindles. A safety device is provided for moving the presser fingers out of the paths of the empty bobbins as the empty bobbins are inserted into the flyers, comprising deformable elements extending longitudinally of the teeth of the fork. The presser fingers have members thereon so positioned as to be engaged by the deformable elements and to swing the presser fingers out of the paths of the empty bobbins when the empty bobbins are inserted into the flyers by movement of the fork in one direction. The presser finger members are also so positioned as to engage the deformable elements upon movement of the fork in a direction opposite that one direction after emplacement of the empty bobbins on the spindles in the flyers, to urge the presser fingers to swing toward the empty bobbins. The deformable elements are in the form of an elongated brush.

2 Claims, 2 Drawing Sheets

SAFETY DEVICE FOR A BANK OF SPINDLES PROVIDED WITH AN AUTOMATIC REMOVAL DEVICE

The present invention relates to textile machines and, more particularly, banks of spindles for long and short fibers, and has for its object a safety device for such a bank of spindles provided with an automatic removal device.

The banks of spindles are generally provided with two rows of spindles arranged on the spindle-carrying carriage, diagonally as the case may be, and to which correspond two rows of flyers. Each of these latter is provided with a pivotal presser finger, provided with a counterweight which, during rotation of flyers, lowers the corresponding presser finger against the bobbin or, respectively, against the bobbin in the course of formation.

The device for automatic removal is principally in the form of a fork whose teeth are introduced, by translatory movement of said fork, between the bobbins disposed on the spindles of the bobbin-carrying carriage, parallel to the transverse alignment of said bobbins and spindles and this, after lowering of said spindle-carrying carriage and the breakage of the yarn. The extraction of said bobbins then consists, on the one hand, in disengaging them from their corresponding spindles by a vertical movement of the fork and, on the other hand, withdrawing said spindle-carrying carriage by a translatory movement opposite that effectuated during engagement of said fork between said bobbins.

To do this, said blades must be stopped such that their arms will be disposed perpendicular to the direction of translation of said fork.

Under these circumstances, the presser fingers of the flyers of the rear row are situated toward the rear and the presser fingers of the flyers of the forward row are situated forwardly. The extraction of the bobbins can therefore be effected without risk, the forward presser fingers opening, which is to say pivoting outwardly, during passage of the bobbins. Nevertheless, during the emplacement of the empty replacement bobbins by means of the fork by movement in the opposite direction, it is necessary that the presser fingers of the flyers of the forward row be open so as not to impede the horizontal introduction of said bobbins.

The object of the present invention is to guarantee the opening of the presser fingers of the flyers of a bank of spindles to facilitate emplacement of the empty bobbins by the fork of an automatic removal device.

To this end, it has for its object a safety device for a bank of spindles provided with an automatic removal device, characterized in that it is in the form of profiles each disposed on one of the teeth of a fork of an automatic removal device for the full bobbins and for supplying empty bobbins and provided with deformable longitudinal elements acting on the counterweights of the presser fingers of the flyers of the forward row during displacement of said fork between said flyers, such that the corresponding presser fingers are respectively either pivoted to open position and maintained in this position, or retracted toward the interior of the flyers, according to the direction of displacement of said fork.

The invention will be better understood from the following description, which relates to preferred embodiments, given by way of non-limiting examples, and explained with reference to the accompanying schematic drawings, in which.

Figure 1:
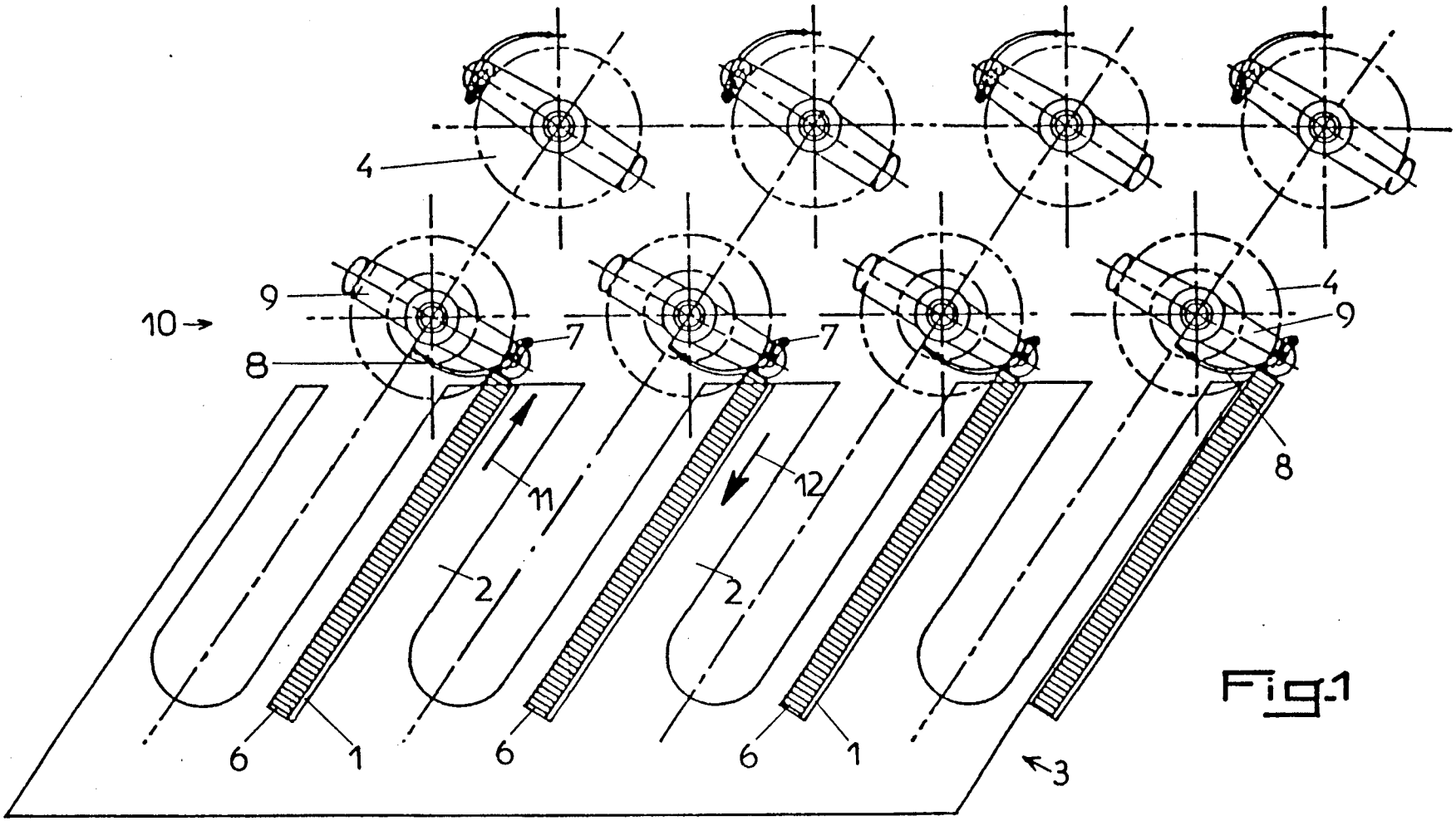
FIG. 1 is a plan view of an automatic removal fork provided with the device according to the invention, at the beginning of the emplacement phase of empty bobbins.

According to the invention, and as shown in FIGS. 1 to 4 of the accompanying drawings, the safety device is in the form of profiles 1 each disposed on one of the teeth 2 of a fork 3 of the automatic device for removal of full bobbins 4 and for supplying empty bobbins 5 and provided with longitudinal deformable elements 6 acting on the counterweights 7 of the presser fingers 8 of the flyers 9 of the forward row 10 during a displacement of said fork 3 between said flyers, such that the corresponding presser fingers 8 are respectively either pivoted into open position and maintained in this position, or retracted toward the interior of the flyers 9, according to the direction of movement 11 or 12 of said fork 3.

Thus when the fork 3 is engaged between the flyers 9, which is to say when it is displaced in the direction indicated by 11 in FIG. 1, the counterweight 7 is pressed rearwardly by the longitudinal deformable element 6. As a result, the corresponding presser finger 8 is completely pivoted outwardly, which is to say into open position (FIG. 2), and permits the passage of the bobbins 5 supplied by the fork 3.

On the other hand, when the fork 3 is retracted, which is to say when it moves in the direction indicated by 12 in FIG. 1, the counterweight 7 is returned forwardly under the action of the deformable longitudinal element 6. Thus, the presser finger 8 is pivoted toward the interior of the flyer 9 and flattened against the napped surface 13 and the winding on the empty bobbins 5 is then begun under optimum conditions.

According to a characteristic of the invention, shown in FIG. 1 of the accompanying drawings, the profile 1 and the longitudinal deformable element 6 have a length corresponding to that of the path of the fork 3 between the flyers 9, so that during the entire phase of introduction of the empty bobbins 5 between the flyers 9, the maintenance of the presser fingers 8 in open position will be ensured.

Figure 4:
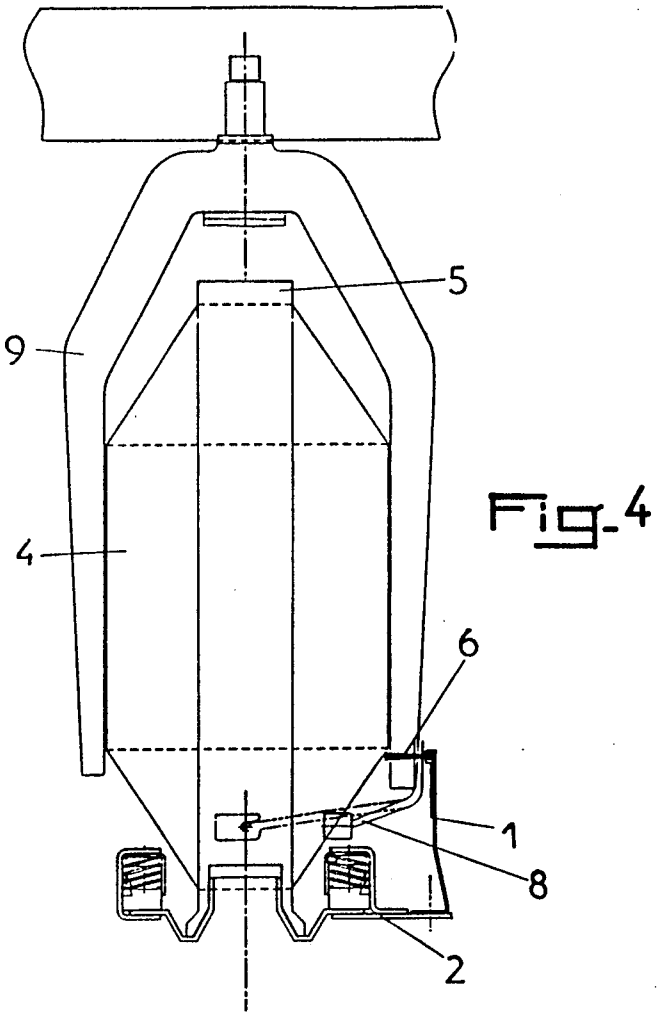
FIG. 4 is a front elevational view of the device shown partially in FIG. 2.
Figure 2:
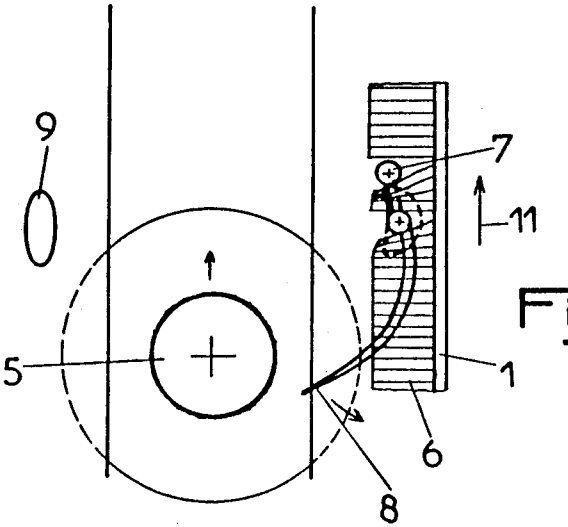
FIG. 2 is a schematic detailed view in cross section of the device shown in FIG. 1, but showing a single flyer, during the phase of emplacing empty bobbins.
Figure 3:
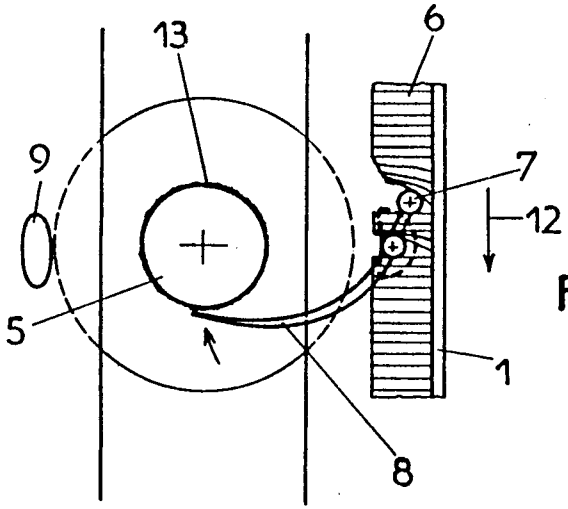
FIG. 3 is a schematic view like that of FIG. 2, during retraction of the fork.

According to a preferred embodiment of the invention, and as shown more particularly in FIGS. 2 to 4 of the accompanying drawings, the longitudinal element 6 is in the form of a flat elongated brush, but this latter could equally well comprise a round, oval or other cross section.

According to a modified embodiment of the invention, not shown in the accompanying drawings, the longitudinal deformable element 6 is present in the form either of a velour ribbon, or a plush band, or an elongated element of foam rubber.

Thanks to the invention, it is therefore possible to provide a safety device for a bank of spindles provided with an automatic removal device comprising particularly a carrying fork 3. Said safety device permits guaranteeing automatic positioning of the empty bobbins 5 without risk of damage to the presser fingers 8 of the flyers 9 as well as flattening the presser fingers 8 against the emplaced bobbins 5 and, as a result, good catching of the broken yarn on the velour 13 of said bobbins 5.

Of course the invention is not limited to the embodiments described and shown in the accompanying drawings. Modifications remain possible, particularly as to the construction of the various elements, or by substitution of technical equivalents, without thereby departing from the scope of protection of the invention.

What is claimed is:

1. In a textile machine having a bank of spindles each provided with a flyer having a presser finger swingable inwardly and outwardly of the flyer, and a fork having a plurality of elongated teeth thereon for simultaneously removing full bobbins from the spindles and for supplying empty bobbins to the spindles; the improvement comprising safety means for moving said presser fingers out of the paths of said empty bobbins as said empty bobbins are inserted into said flyers, said safety means comprising deformable elements mounted on and extending longitudinally of the teeth of the fork, said presser fingers having members thereon so positioned as to be engaged by said deformable elements to swing said presser fingers outwardly of the flyers and out of the paths of said empty bobbins when said empty bobbins are inserted into said flyers by movement of said fork in one direction, said presser finger members also being so positioned as to engage said deformable elements upon movement of said fork in a direction opposite said one direction after emplacement of said empty bobbins on said spindles in said flyers, to urge said presser fingers to swing toward said empty bobbins.

2. Structure as claimed in claim 1, wherein said deformable elements are elongated brushes extending parallel to said directions of movement of said fork and having bristles that extend toward said bobbins and that are contacted by said presser finger members during movement of said fork in both directions.

* * * * *